US011330895B2

(12) United States Patent
Noonan, Jr. et al.

(10) Patent No.: US 11,330,895 B2
(45) Date of Patent: May 17, 2022

(54) DENTAL CLEANING APPARATUS

(71) Applicants: Joseph E Noonan, Jr., Belgrade, ME (US); Daniel J Noonan, Austin, TX (US)

(72) Inventors: Joseph E Noonan, Jr., Belgrade, ME (US); Daniel J Noonan, Austin, TX (US)

( * ) Notice: Subject to any disclaimer, the term of this patent is extended or adjusted under 35 U.S.C. 154(b) by 243 days.

(21) Appl. No.: 16/785,600

(22) Filed: Feb. 8, 2020

(65) Prior Publication Data

US 2021/0244171 A1 Aug. 12, 2021

(51) Int. Cl.

| | |
|---|---|
| ***A46B 9/04*** | (2006.01) |
| ***A46B 5/00*** | (2006.01) |
| ***A46B 5/02*** | (2006.01) |

(52) U.S. Cl.

CPC ..... *A46B 9/045* (2013.01); *A46B 5/0012* (2013.01); *A46B 5/02* (2013.01); *A46B 2200/1066* (2013.01)

(58) Field of Classification Search

CPC ..... A46B 9/045; A46B 5/0012; A46B 5/02
USPC ..... 15/167.2, 143.1–144.1
See application file for complete search history.

(56) References Cited

U.S. PATENT DOCUMENTS

| | | | |
|---|---|---|---|
| 1,492,660 | A | 5/1923 | Arkus |
| 2,053,905 | A | 5/1933 | Fuller |
| 2,130,661 | A | 11/1933 | Zaebst |
| 2,056,447 | A | 6/1934 | Fell |
| 2,090,663 | A | 12/1934 | Booth |
| 2,047,613 | A | 1/1935 | Brown |
| 2,066,772 | A | 4/1935 | Doyle |
| 2,040,245 | A | 5/1935 | Crawford |
| 2,111,238 | A | 7/1935 | Doyle |
| 2,114,947 | A | 9/1935 | Warsaw |
| 2,139,593 | A | 5/1936 | Kohler |
| 2,146,455 | A | 5/1936 | Tepper |
| 2,043,898 | A | 6/1936 | Malcolm |
| 2,111,876 | A | 3/1937 | Swenson |
| 2,110,461 | A | 5/1937 | Chibnik |
| 2,175,975 | A | 5/1937 | Steiner |

(Continued)

FOREIGN PATENT DOCUMENTS

| | | | | |
|---|---|---|---|---|
| CN | 103763982 A | * | 4/2014 | ..... A46B 5/026 |
| JP | 2000033010 A | | 2/2000 | |

(Continued)

OTHER PUBLICATIONS

English translation of KR 10-1202105 B1, Hong, Dec. 2012. (Year: 2012).*

(Continued)

*Primary Examiner* — Laura C Guidotti
(74) *Attorney, Agent, or Firm* — Mark P Kahler

(57) ABSTRACT

A dental cleaning apparatus (DCA) includes an elongated member having a brush portion and a handle portion. The DCA includes multiple brushes with different respective geometries situated equiangularly about the brush portion. The brushes may include convex, concave and flat geometries with each brush being designated for cleaning a different respective tooth surface type. For each of the convex, concave and flat bushes, the DCA includes a respective tactile feel region exhibiting the same geometry as the brush type to aid the user in orienting the DCA in the mouth for tooth cleaning purposes.

16 Claims, 7 Drawing Sheets

(56) References Cited

U.S. PATENT DOCUMENTS

| | | | | |
|---|---|---|---|---|
| 2,186,005 | A | 4/1939 | Casto | |
| 2,588,601 | A | 2/1950 | Zavagno | |
| 3,398,421 | A | 8/1968 | Rashbaum | |
| 3,939,520 | A | 2/1976 | Axelsson | |
| D248,696 | S | 8/1978 | Greenberg | |
| 4,894,880 | A | 1/1990 | Aznavoorian | |
| 5,499,422 | A | 3/1996 | Lavazoli | |
| 5,655,249 | A | 8/1997 | Li | |
| 6,182,321 | B1 | 2/2001 | Wu | |
| 6,357,073 | B1 | 3/2002 | Yue | |
| 6,374,450 | B1 | 4/2002 | Aoyama | |
| 6,397,858 | B1 | 6/2002 | Cubillo | |
| 6,883,200 | B1 | 4/2005 | Euler | |
| 7,757,330 | B2 | 7/2010 | Hegemann | |
| 8,079,106 | B2 | 12/2011 | Yang | |
| 8,499,401 | B2 * | 8/2013 | Davidson | A46B 11/0017 15/167.1 |
| 8,516,642 | B1 | 8/2013 | Farahat | |
| 8,938,841 | B1 | 1/2015 | Ramirez | |
| 9,271,816 | B2 | 3/2016 | Babiner | |
| 9,339,357 | B1 | 5/2016 | Babiner | |
| D761,025 | S * | 7/2016 | Hinckley | D4/105 |
| 9,648,942 | B2 | 5/2017 | Nadeau | |
| 9,844,207 | B1 | 12/2017 | Wright | |
| 2001/0013151 | A1 | 8/2001 | Gelder | |
| 2006/0272113 | A1 * | 12/2006 | Cato | A46B 9/04 15/106 |
| 2008/0028559 | A1 | 2/2008 | Kim | |
| 2009/0049628 | A1 | 2/2009 | Abbott | |
| 2010/0236006 | A1 | 9/2010 | Deng | |
| 2011/0209299 | A1 | 9/2011 | Simovitz | |
| 2012/0054971 | A1 | 3/2012 | Dugan | |
| 2015/0374100 | A1 * | 12/2015 | Wilson | A46B 3/06 401/129 |

FOREIGN PATENT DOCUMENTS

| | | | | |
|---|---|---|---|---|
| JP | 2001346633 | A | 12/2001 | |
| KR | 10-1202105 | B1 * | 12/2012 | A46B 9/04 |
| WO | 2000040115 | A1 | 7/2000 | |
| WO | 2010101363 | A2 | 9/2010 | |

OTHER PUBLICATIONS

English translation of CN 103763982 A, Kobayashi, Apr. 2014. (Year: 2014).*

ADVANTAGE—"The Five Types of Human Teeth & Their Function", downloaded from https://aci.edu/five-types-human-teeth-function/, Mar. 13, 2015 (pp. 1-7).

Dental Health—"Tooth Types", downloaded from https://www.dentalhealth.ie/children/toothdevelopment/types.html, on Jun. 8, 2019 (pp. 1-2).

Dentrust—"Dentrust 3-Sided Toothbrush—Soft Bristles", downloaded from https://www.kleenteeth.com/ Jan. 1, 2019 (pp. 1-2).

Dr. Barman—Dr. Barman's Super Brush—Normal Head, downloaded from https://www.kleenteeth.com/ on Jan. 1, 2019 (pp. 1-2).

Sahi—"Universal Numbering System for Teeth", downloaded from https://www.news-medical.net/health/Universal-Numbering-System-for-Teeth.aspx on Jun. 21, 2019 (pp. 1-10).

Wilkins—"Parts of a Toothbrush—Figure 15-1" from "Clinical Practice of The Dental Hygienist" downloaded from https://image.slidesharecdn.com/toothbrush-a-141205112510-conversion-gate01/95/toothbrush-a-17-638.jpg?cb=1417780099 on Dec. 30, 2018 (p. 1).

30 Second Smile—"30 Second Smile—Standard Soft (4 Pack) Dual Brush Replacement Heads for Electric Toothbrush", downloaded from www.amazon.com on Jan. 1, 2019 (pp. 1-6).

Babyease—"Children 3-Sided Toothbrush, Soft Wrap-around Training Tooth brush Saving Time for Baby Brushing", downloaded from www.amazon.com on Jan. 1, 2019 (pp. 1-8).

Specialized Care—"Surround Toothbrush", downloaded from www.amazon.com on Jan. 1, 2019 (pp. 1-6).

Triple Bristle—"Triple Bristle Best Sonic Electric Toothbrush", downloaded from www.amazon.com on Jan. 1, 2019 (pp. 1-10).

* cited by examiner

200

200

200

200

200

DENTAL CLEANING APPARATUS

BACKGROUND

The disclosures herein relate generally to apparatus for cleaning mammalian teeth, and more particularly to a dental cleaning apparatus that is easily used to clean the different surfaces of mammalian teeth.

BRIEF SUMMARY

In one embodiment, a dental cleaning apparatus is disclosed that includes an elongated member having a brush portion and a handle portion respectively situated at opposed ends of the elongated member. The dental clearing apparatus also includes a plurality of bristle arrays situated approximately equiangularly spaced about the brush portion of the elongated member, each bristle array of the plurality of bristle arrays exhibiting a different bristle array geometry, each bristle array geometry being shaped to brush a different type of tooth surface.

In another embodiment, a dental cleaning apparatus is disclosed that includes an elongated member including a brush portion and a handle portion respectively situated at opposed ends of the elongated member. The dental clearing apparatus includes first, second and third bristle arrays situated at approximately 0°, approximately 120° and approximately 240° about the brush portion. The dental clearing apparatus also includes first, second and third tactile feel regions situated at approximately 0°, approximately 120° and approximately 240° about the handle portion. In this embodiment, the first tactile feel region is aligned with the first bristle array in a first plane. The second tactile feel region is aligned with the second bristle array in a second plane. The third tactile fee region is aligned with the third bristle array in a third plane. In this embodiment, the first bristle array and the corresponding first tactile feel region both exhibit a convex geometry. The second bristle array and the corresponding second tactile feel region both exhibit a concave geometry. The third bristle array and the corresponding third tactile feel region both exhibit a flat geometry.

BRIEF DESCRIPTION OF THE DRAWINGS

The appended drawings illustrate only exemplary embodiments of the invention and therefore do not limit its scope because the inventive concepts lend themselves to other equally effective embodiments.

DETAILED DESCRIPTION

Mammalian teeth include surfaces with varying surface geometries depending on their position in the mammal's mouth. For example, front teeth may include convex anterior surfaces and concave posterior surfaces, while rearward teeth may include relatively flat anterior and posterior surfaces together as well as chewing surfaces.

Figure 1A:
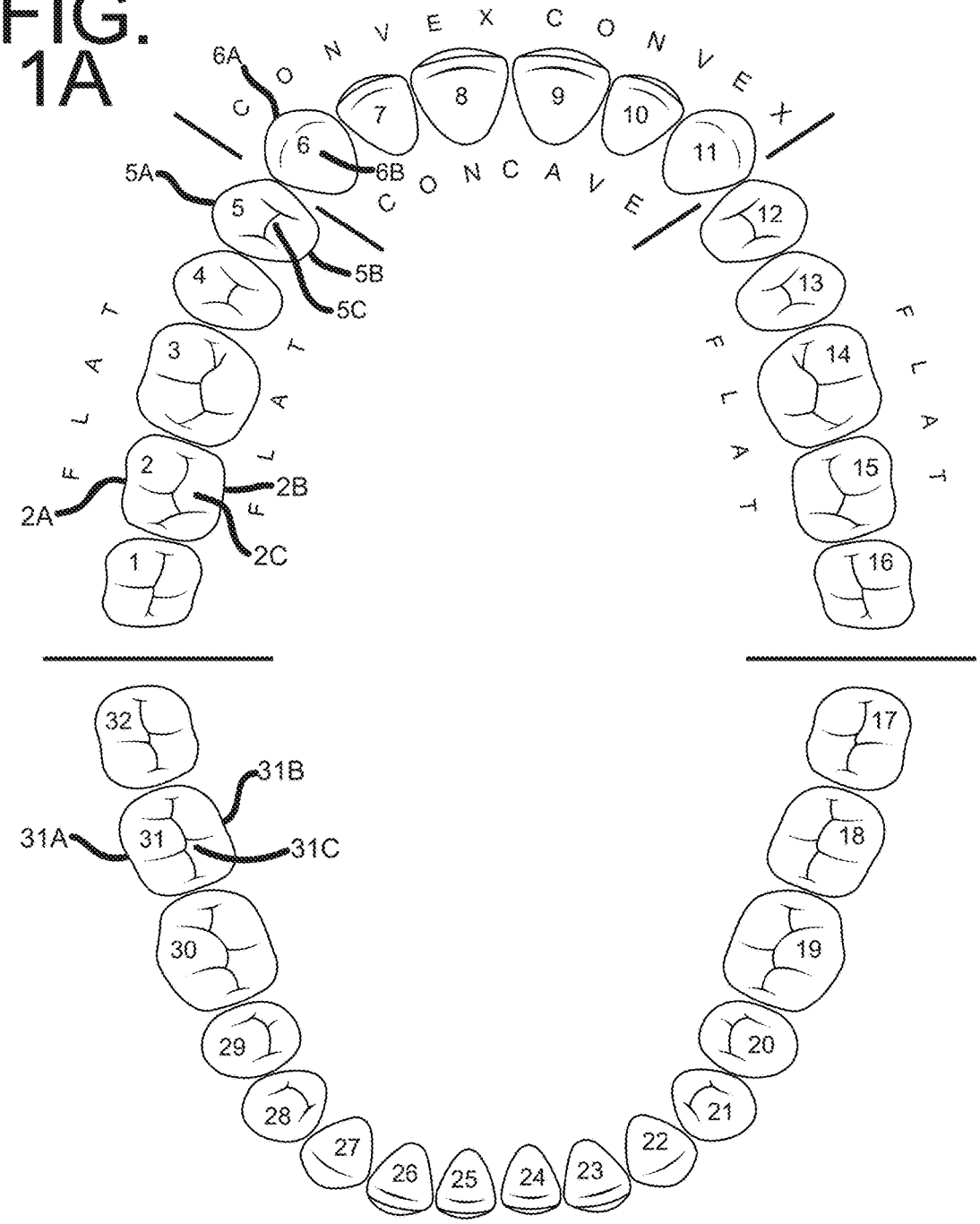
FIG. 1A is a representation of the permanent teeth in the human mouth in accordance with the "Universal Number System" which is alternatively called the "American System".

FIG. 1A is representation of the permanent teeth in the human mouth in accordance with the "Universal Number System" that is alternatively referred to as the "American System". Teeth 1-16 are upper teeth, while teeth 17-32 are lower teeth. For reference, tooth 1 is the maxillary right third molar (a "wisdom" tooth). In FIG. 1A, teeth 1-32 are illustrated from the viewpoint of the dental practitioner. Thus, in the tooth diagram chart of TABLE 1 below, tooth 1 is situated in the upper right of the patient's mouth from the patient's perspective.

TABLE 1

| TOOTH NUMBER | DESCRIPTION |
|---|---|
| 1 (upper right) | 3rd molar (wisdom tooth) |
| 2 (upper right) | $2^{nd}$ molar (12 year molar) |
| 3 (upper right) | $1^{st}$ molar (6 year molar) |
| 4 (upper right) | $2^{nd}$ bicuspid ($2^{nd}$ premolar) |
| 5 (upper right) | $1^{st}$ bicuspid ($1^{st}$ premolar) |
| 6 (upper right) | Cuspid (canine/eye tooth) |
| 7 (upper right) | Lateral incisor |
| 8 (upper right) | Central incisor |
| 9 (upper left) | Central incisor |
| 10 (upper left) | Lateral incisor |
| 11 (upper left) | Cuspid (canine/eye tooth) |
| 12 (upper left) | $1^{st}$ bicuspid ($1^{st}$ premolar) |
| 13 (upper left) | $2^{nd}$ bicuspid ($2^{nd}$ premolar) |
| 14 (upper left) | $1^{st}$ molar (6 year molar) |
| 15 (upper left) | $2^{nd}$ molar (12 year molar) |

TABLE 1-continued

| TOOTH NUMBER | DESCRIPTION |
|---|---|
| 16 (upper left) | 3rd molar (wisdom tooth) |
| 17 (lower left) | 3rd molar (wisdom tooth) |
| 18 (lower left) | $2^{nd}$ molar (12 year molar) |
| 19 (lower left) | $1^{st}$ molar (6 year molar) |
| 20 (lower left) | $2^{nd}$ bicuspid ($2^{nd}$ premolar) |
| 21 (lower left) | $1^{st}$ bicuspid ($1^{st}$ premolar) |
| 22 (lower left) | Cuspid (canine/eye tooth) |
| 23 (lower left) | Lateral incisor |
| 24 (lower left) | Central incisor |
| 25 (lower right) | Central incisor |
| 26 (lower right) | Lateral incisor |
| 27 (lower right) | Cuspid (canine/eye tooth) |
| 28 (lower right) | $1^{st}$ bicuspid ($1^{st}$ premolar) |
| 29 (lower right) | $2^{nd}$ bicuspid ($2^{nd}$ premolar) |
| 30 (lower right) | $1^{st}$ molar (6 year molar) |
| 31 (lower right) | $2^{nd}$ molar (12 year molar) |
| 32 (lower right) | 3rd molar (wisdom tooth) |

The following is a list of elements that are referenced in FIGS. 1, 2A-2I, 3 and the specification:

1-16 upper teeth
17-32 lower teeth
1 maxillary right $3^{rd}$ molar
2A flat anterior surface
2B flat posterior surface
2C chewing surface
5A flat anterior surface
5B flat posterior surface
5C chewing surface
6A convex anterior surface
6B concave posterior surface
31A flat anterior surface
31B flat posterior surface
31C chewing surface
200 Dental cleaning apparatus (DCA)
202 Brush portion
202A Brush end
204 Handle portion
204A Handle end
206 Elongated member
206A Elongated member end
206B Elongated member end
211 Convex brush
212 Concave brush
213 Flat brush
221 Convex tactile feel region
222 Concave tactile feel region
223 Flat tactile feel region
A-A' Plane
B-B' Plane
C-C' Plane
230 central core
241 open region
242 open region
243 open region FIG. 1A shows a representative upper left front tooth 6 as including a convex anterior surface 6A facing outward and a concave posterior surface 6B facing inward. Other front teeth 7-11 likewise include respective convex anterior surfaces and concave posterior surfaces, although they are not individually labelled in this view. Rearward teeth are defined as the remaining teeth in FIG. 1 that do not exhibit convex anterior surfaces and concave posterior surfaces. More specifically, upper rearward teeth 1-5 and 12-16 include substantially vertically flat anterior surfaces, substantially vertically flat posterior surfaces and chewing surfaces.

For example, rearward tooth 5 includes a substantially vertically flat anterior surface 5A, a substantially vertically flat posterior surface 5B and a chewing surface 5C extending therebetween as shown in FIG. 1A. The term "vertically flat" as used herein means that the anterior surfaces and posterior surfaces of the rearward teeth 1-5 and 12-16 are significantly flatter than the convex anterior surfaces and concave posterior surfaces of front teeth 6-11, as seen in FIG. 1A.

Figure 1B:
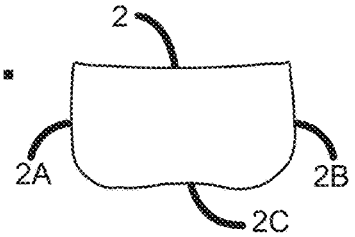
FIG. 1B depicts a representative upper rear molar of FIG. 1A.

In another example, upper rearward tooth 2 includes a substantially vertically flat anterior surface 2A, a substantially vertically flat posterior surface 2B and a chewing surface 2C extending therebetween, also as shown in FIG. 1A. FIG. 1B is a front view of tooth 2 as viewed from the mouth without obstruction. FIG. 1B shows more detail of substantially vertically flat surfaces 2A and 2B together with chewing surface 2C therebetween.

Figure 1C:
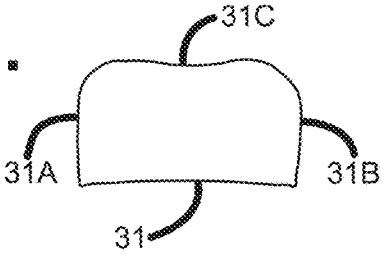
FIG. 1C depicts a representative lower rear molar of FIG. 1A.

In another example that is directed now to the lower rearward teeth, rearward tooth 31 includes a substantially vertically flat anterior surface 31A, a substantially vertically flat posterior surface 31B and a chewing surface 31C extending therebetween, also as shown in FIG. 1A. FIG. 1C is a front view of tooth 31 as viewed from the mouth without obstruction. FIG. 1C shows more detail of substantially vertically flat surfaces 31A and 31B together with chewing surface 31C therebetween.

Figure 2A:
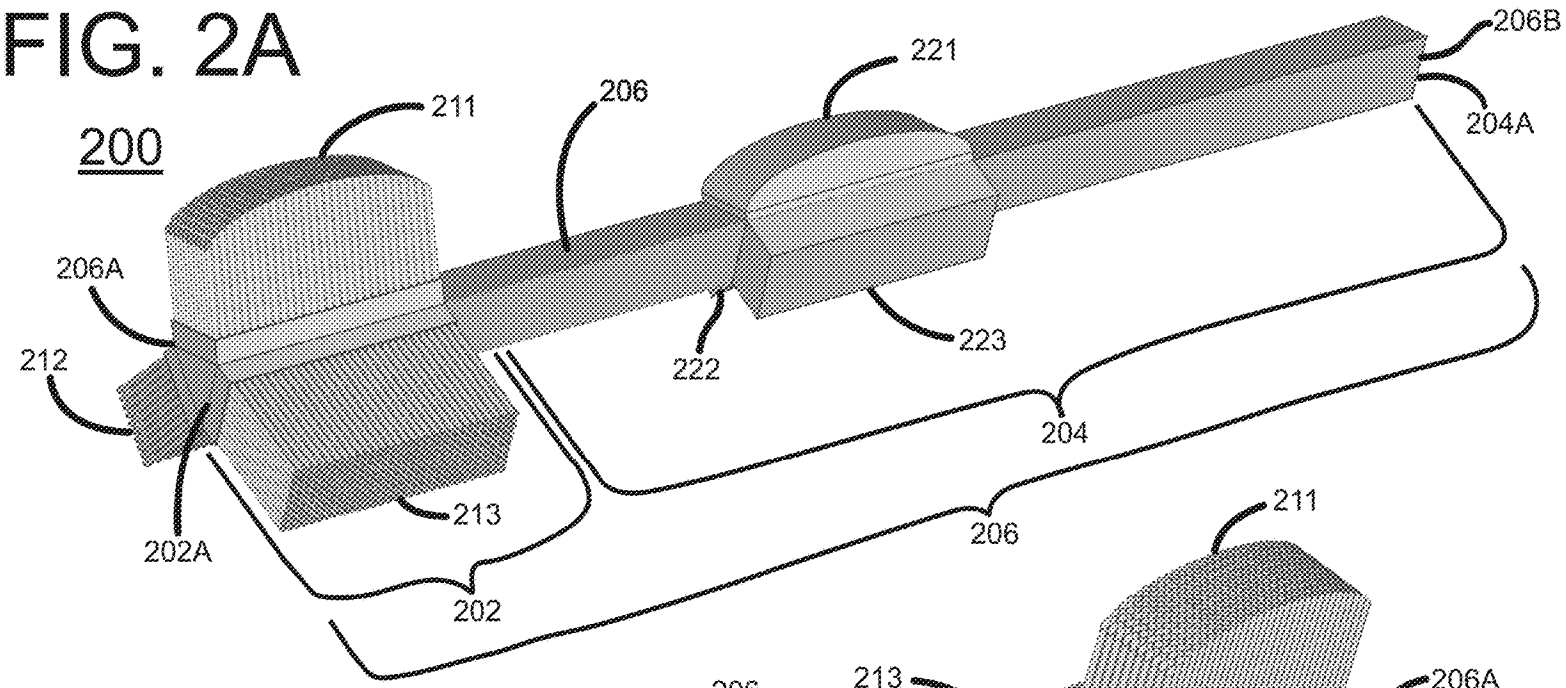
FIG. 2A is a left-end perspective view of one embodiment of the disclosed dental cleaning apparatus shown oriented with a convex bristle array and corresponding convex tactile feel region both positioned on top.
Figure 2B:
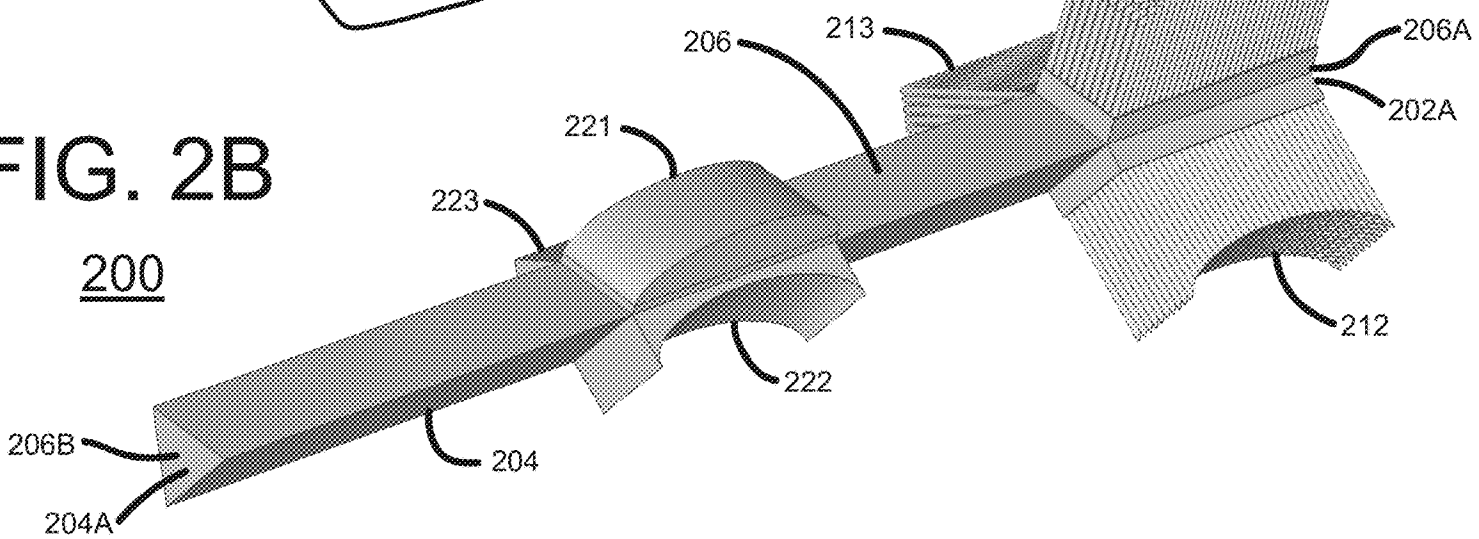
FIG. 2B is a right-end perspective view of one embodiment of the disclosed dental cleaning apparatus shown oriented with a convex bristle array and corresponding convex tactile feel region both positioned on top.

FIG. 2A shows a left-end perspective view of a non-limiting embodiment of the disclosed dental cleaning apparatus (DCA) as DCA 200. FIG. 2B is a right-end perspective view of DCA 200. In this particular embodiment, DCA 200 includes a brush portion 202 and a handle portion 204 that together form an elongated member 206. Brush portion 202 and a handle portion 204 may be fabricated integrally as part of the same structure or may be fabricated separately and joined together in the final assembly of DCA 200. In another embodiment, brush portion 202 is removable (i.e. separable) from handle portion 204 to enable brush replacement after extensive use and wear. Elongated member 206 includes opposed ends 206A and 206B.

DCA 200 includes multiple brushes 211, 212 and 213 situated about brush portion 202. Brushes 211, 212 and 213 may alternatively be referred to as bristle arrays. In the embodiment of FIG. 2A, brushes 211, 212 and 213 are equiangularly spaced about brush portion 202 at approximately 0°, approximately 120° and approximately 240°. Each of brushes 211, 212 and 213 exhibits a different geometry which is selected to brush a corresponding mating geometry of a tooth surface. For example, brush 211 exhibits a convex geometry and is intended for brushing concave tooth surfaces such as the concave posterior surfaces of teeth 6-11 of FIG. 1A, of which concave posterior surface 6B is specifically marked in FIG. 1A. Brush 212 exhibits a concave geometry and is intended for brushing convex tooth surfaces such as the convex anterior surfaces of teeth 6-11 of FIG. 1A, of which convex anterior surface 6A is specifically marked in FIG. 1A. Brush 213 exhibits a flat geometry and is intended for brushing flat tooth surfaces such as the flat anterior and posterior surfaces 5A and 5B of rearward tooth 5 of FIG. 1A. Flat brush 213 is also intended for brushing flat tooth surfaces such as the flat anterior and posterior surfaces 2A and 2B of rearward tooth 2 of FIG. 1A and FIG. 1B, and further to brush the flat anterior and posterior surfaces 31A and 31B of rearward tooth 31 of FIG. 1A and FIG. 1C. Moreover, flat brush 213 is further intended for brushing the chewing surfaces of teeth 1-5 and 12-16, of which chewing surfaces 2C and 5C are shown in FIG. 1A, and wherein chewing surface 2C is also shown in FIG. 1B.

The statements above with respect to a particular brush geometry being used to brush a corresponding tooth surface type of upper teeth 1-16 apply as well to lower teeth 17-32 in a one-to-one relationship. For example, convex brush 211 may be used to brush the posterior concave surfaces of not only upper teeth 6-11, but also to brush the posterior concave surfaces of lower teeth 22-27. Likewise, concave brush 212 may be used to brush the anterior convex surfaces of not only upper teeth 6-11, but also the corresponding anterior convex surfaces of lower teeth 22-27. Moreover, flat brush 213 may be used not only to brush the chewing surfaces, flat anterior surfaces and flat posterior surfaces of rearward teeth 1-5 and 12-16 of the upper mouth, but also to brush the corresponding chewing surfaces, flat anterior surfaces and flat posterior surfaces of rearward teeth 17-21 and 28-32 of the lower mouth. In other words, the same principles disclosed above with respect to the upper teeth apply as well to the lower teeth. It is noted that teeth 5 and 12 are considered as being transitional teeth and can be brushed with either a convex or flat surface.

FIGS. 2A and 2B, when viewed together cumulatively, show a convex tactile feel region 221, a concave tactile feel region 222 and a flat tactile feel region 223 aligned with convex brush 211, concave brush 212 and flat brush 213, respectively. These tactile feel regions assist the DCA user in determining the orientation of the brushes 211, 212 and 213 without looking at them, as discussed in more detail below.

Figure 2D:
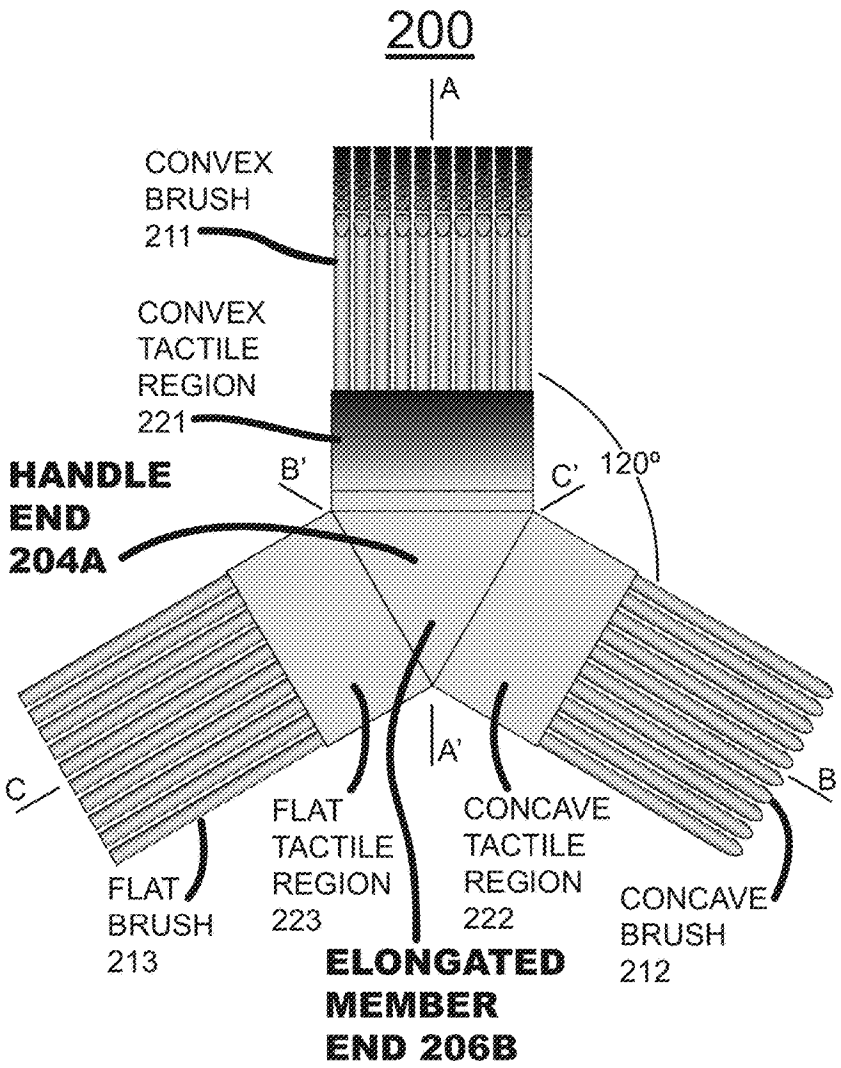
FIG. 2D is a right-end plan view of one embodiment of the disclosed dental cleaning apparatus.
Figure 2C:
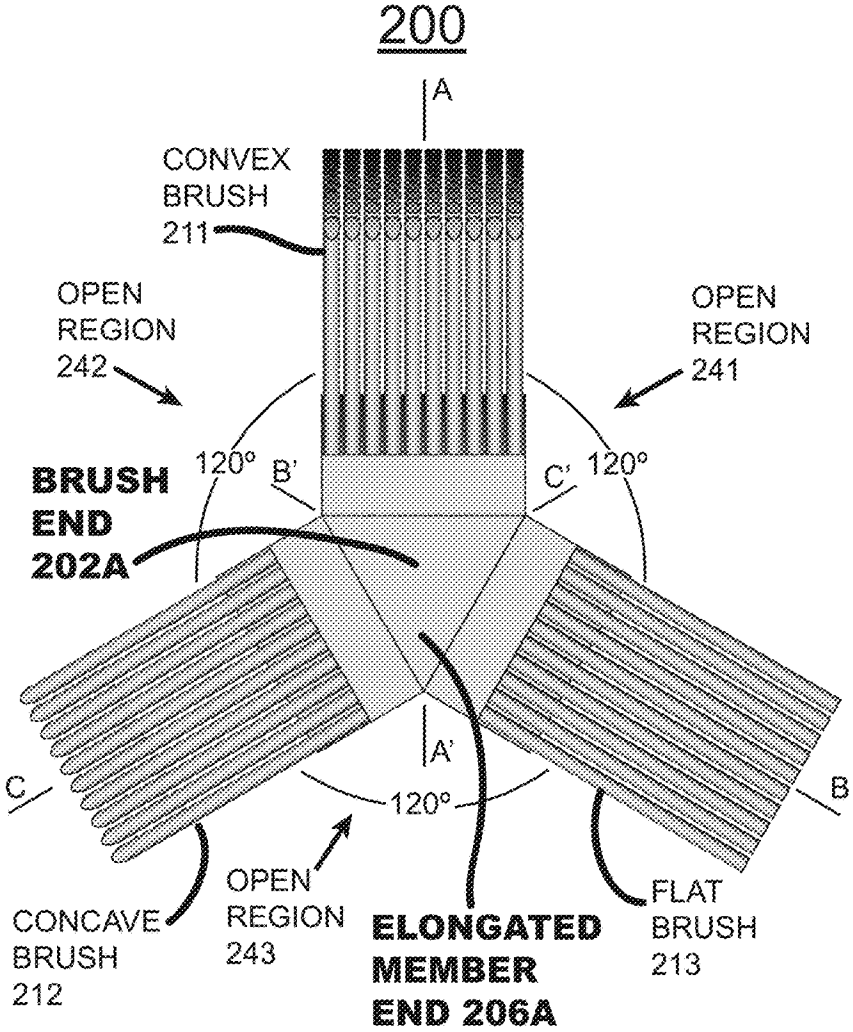
FIG. 2C is a left-end plan view of one embodiment of the disclosed dental cleaning apparatus.

FIG. 2C is a brush end plan view of DCA 200, while FIG. 2D is a handle end plan view of DCA 200. As seen in FIG. 2C, convex brush 211, concave brush 212 and flat brush 213 are approximately equiangularly spaced apart about brush end 202A. The angular spacing among brushes 211, 212 and 213 is approximately 120° in this embodiment. As seen in FIG. 2D, convex brush 211 is aligned with corresponding convex tactile feel region 221, because both are situated in the same plane A-A'. Moreover, concave brush 212 is aligned with corresponding concave tactile feel region 222, because both are situated in the same plane B-B'. Further, flat brush 213 is aligned with corresponding convex flat tactile feel region 223, because both are situated in the same plane C-C'. As seen in FIG. 2A, DCA 200 includes 1) an open region 241 between convex brush 211 and flat brush 213, 2) an open region 242 between convex brush 211 and concave brush 212, and 3) an open region 243 between concave brush 212 and flat brush 213.

In another embodiment, the DCA may include 2 brushes such as convex brush 211 and concave brush 212 equiangularly spaced about brush portion 202 at approximately 0° and approximately 180°. In yet another embodiment, the DCA may include 2 brushes such as convex brush 211 and flat brush 213 equiangularly spaced about brush portion 202 at approximately 0° and approximately 180°. In still another embodiment, the DCA may include 2 brushes such as concave brush 212 and flat brush 213 equiangularly spaced about brush portion 202 at approximately 0° and approximately 180°. In these last 3 embodiments wherein the DCA includes 2 different geometry brushes, respective matching tactile feel regions may be aligned with the corresponding 2 brushes to denote the geometry (convex, concave or flat) of the respective brushes.

Figure 2E:
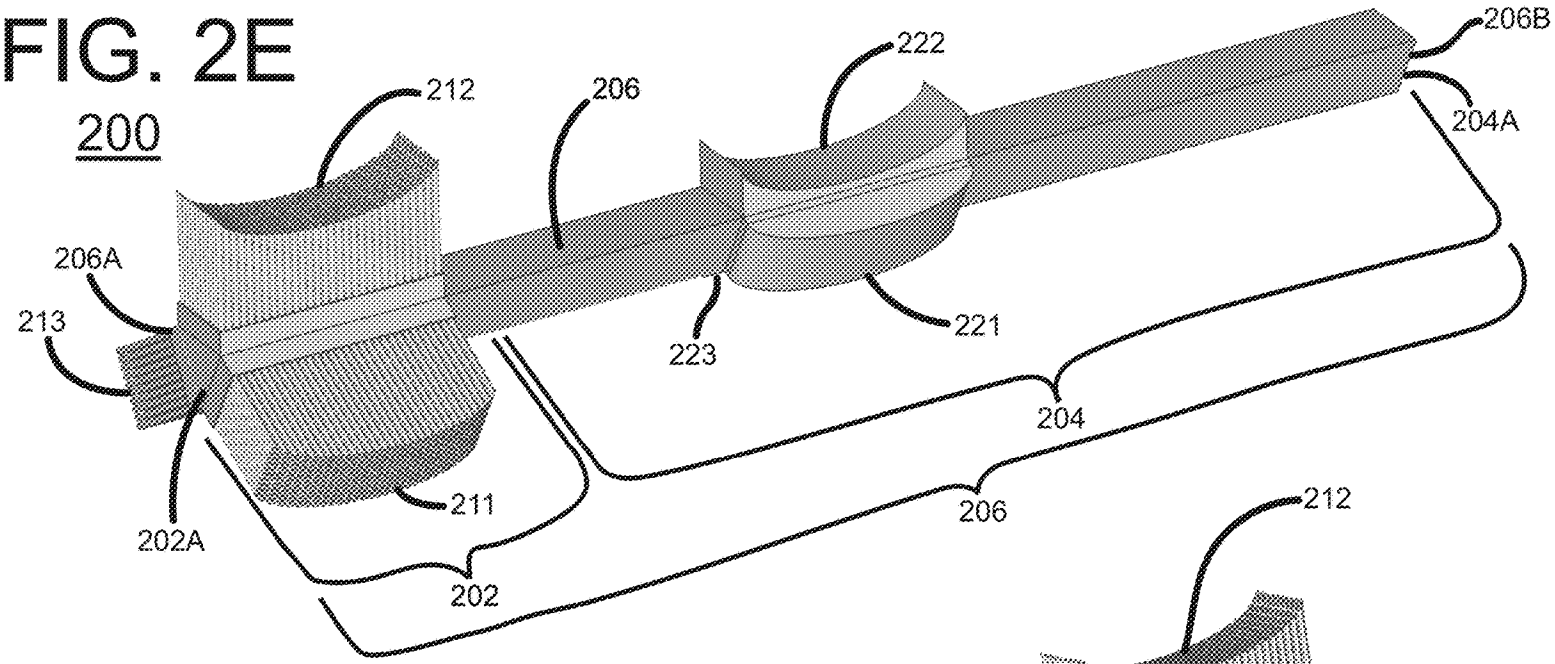
FIG. 2E is a left-end perspective view of one embodiment of the disclosed dental cleaning apparatus shown oriented with a concave bristle array and corresponding concave tactile feel region both positioned on top.
Figure 2F:
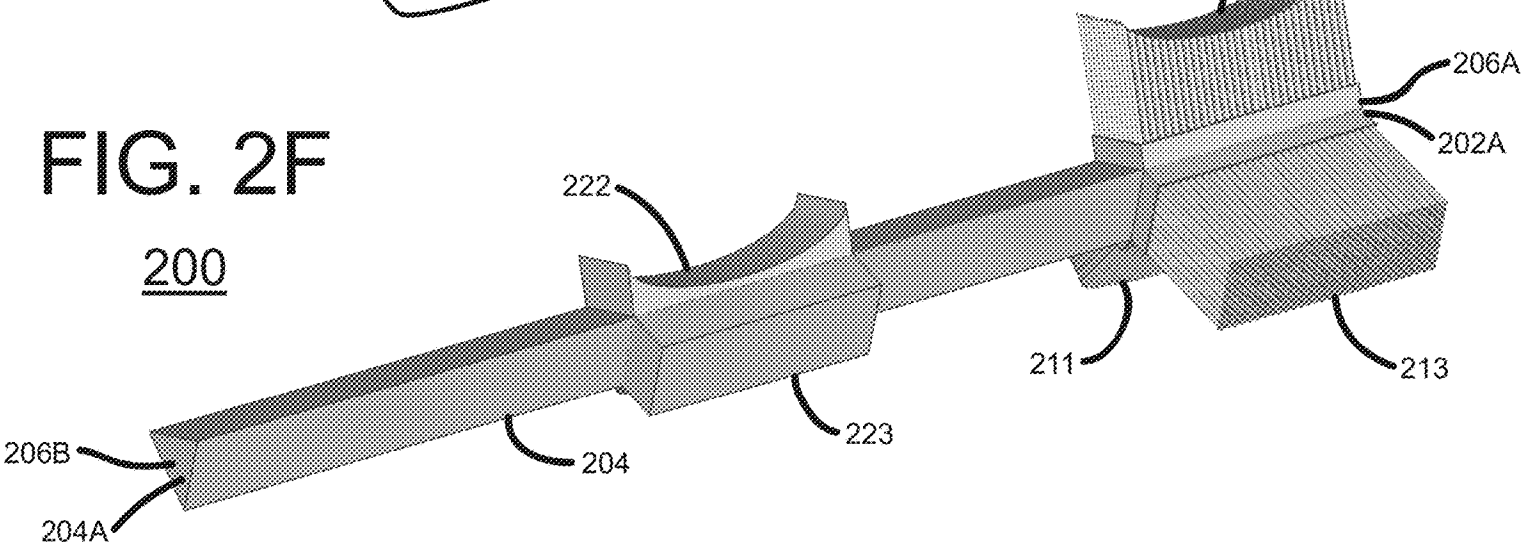
FIG. 2F is a right-end perspective view of one embodiment of the disclosed dental cleaning apparatus shown oriented with a concave bristle array and corresponding concave tactile feel region both positioned on top.
Figure 2G:
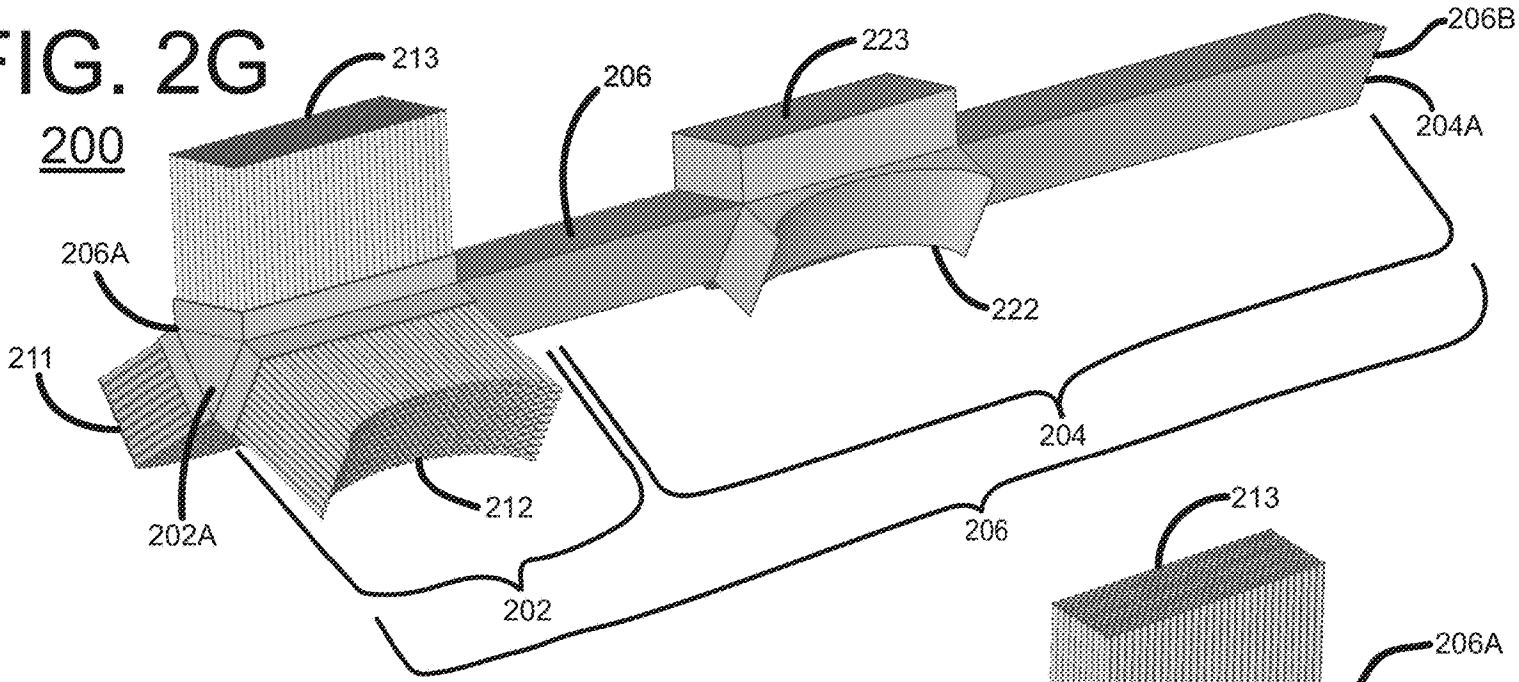
FIG. 2G is a left-end perspective view of one embodiment of the disclosed dental cleaning apparatus shown oriented with a flat bristle array and corresponding flat tactile fee region both positioned on top.
Figure 2H:
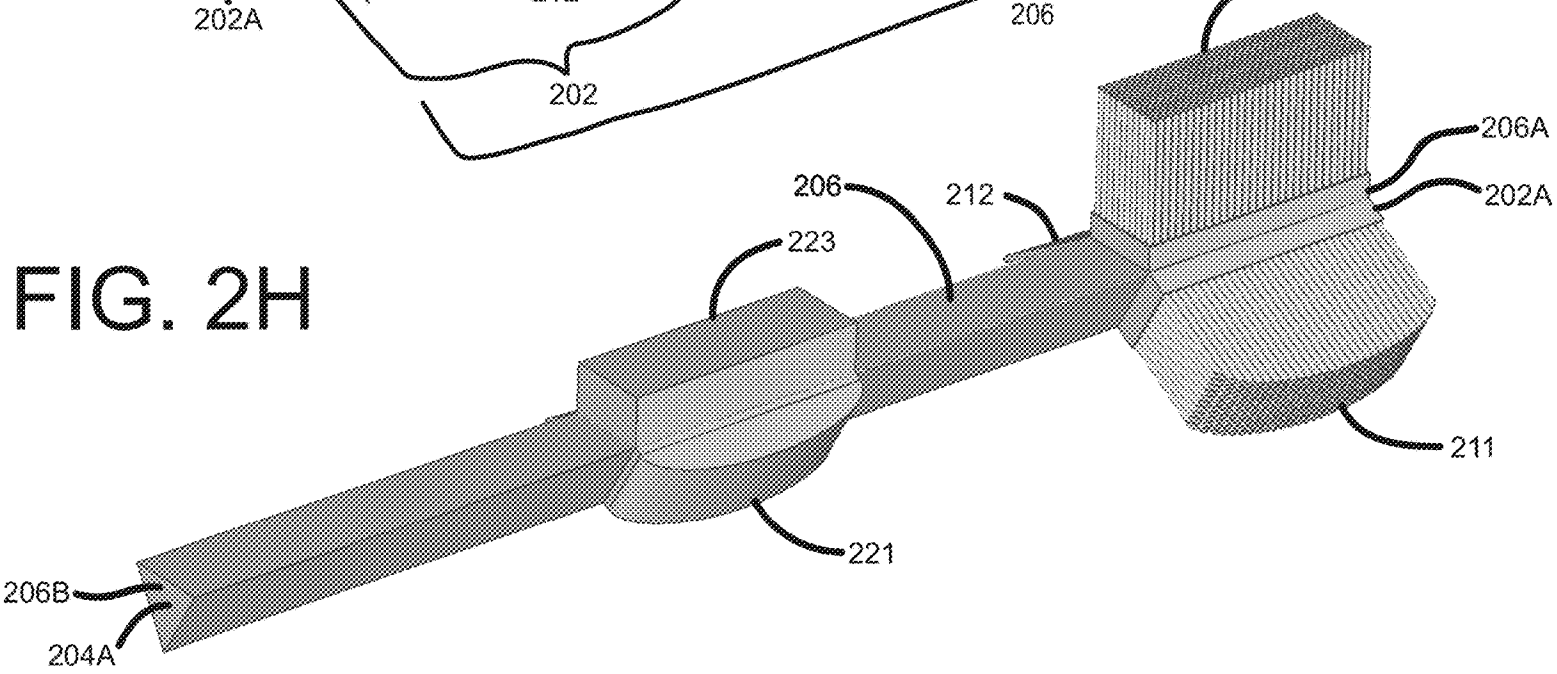
FIG. 2H is a right-end perspective view of one embodiment of the disclosed dental cleaning apparatus shown oriented with a flat bristle array and corresponding concave tactile fee region both positioned on top.

FIG. 2E is a brush end perspective view of DCA 200 oriented with the concave brush 212 and its corresponding aligned concave tactile feel region 222 facing upward. FIG. 2F is a handle end perspective view of DCA 200 of FIG. 2E. FIG. 2G is a brush end perspective view of DCA 200 oriented with the flat brush 213 and its corresponding aligned flat tactile feel region 223 facing upward. FIG. 2H is a handle end perspective view of DCA 200 of FIG. 2G.

To use DCA 200, the user inserts DCA 200 into the mouth and brushes a particular geometry tooth surface with a corresponding mating geometry brush array. For example, to brush the posterior concave surfaces of front teeth 6-11, the user inserts DCA 200 into the mouth while orienting the convex brush 211 to brush these posterior concave tooth surfaces. In FIG. 2A, convex brush 211 is oriented facing upward. Without the user looking, to aid the user in recognizing the particular brush of brushes 211, 212 and 213 that is currently being used for brushing, DCA 200 includes a respective tactile feel region 221, 222 and 223 aligned with each brush. As seen in FIGS. 2A and 2B, DCA 200 includes a convex tactile feel region 221 that is aligned with convex brush 211. When the user places the user's thumb or other member on convex tactile feel region 221, the user the immediately knows the orientation of the corresponding aligned convex brush 211. When finished brushing with convex brush 211, the user may rotate the DCA 200 to use another geometry brush such as concave brush 212 or flat brush 213. Advantageously, without needing to remove DCA 200 from the mouth, the user rotates DCA 200 until the user feels another tactile feel region such as concave tactile feel region 222. When the user feels concave tactile feel region 222, the user immediately knows the orientation of concave brush 212 without the necessity of removing DCA 200 from the mouth to visually inspect the orientation of concave brush 212.

When the user is done brushing with concave brush 212 and wishes to commence brushing with flat brush 213, without removing the brush from the mouth, the user rotates DCA 200 until the user feels flat tactile feel region 223. When the user's thumb or other member senses flat tactile feel region 223, the user immediately knows the orientation of flat brush 213. The user then proceeds with brushing by using flat brush 213 to brush the flat tooth surfaces or other appropriate tooth surfaces.

For ease of understanding and illustration, some of the features of DCA 200 have been emphasized and not drawn to scale. In actual practice, the brushes 211, 212 and 213 may exhibit a much lower profile than illustrated to allow for easier movement in the mammalian mouth. Using a smaller profile for brushes 211, 212 and 213 is helpful when DCA 200 is used on smaller mammals such as humans. Likewise, tactile feel regions 221, 222 and 223 may exhibit a much lower profile than illustrated for the same reason.

Figure 3:
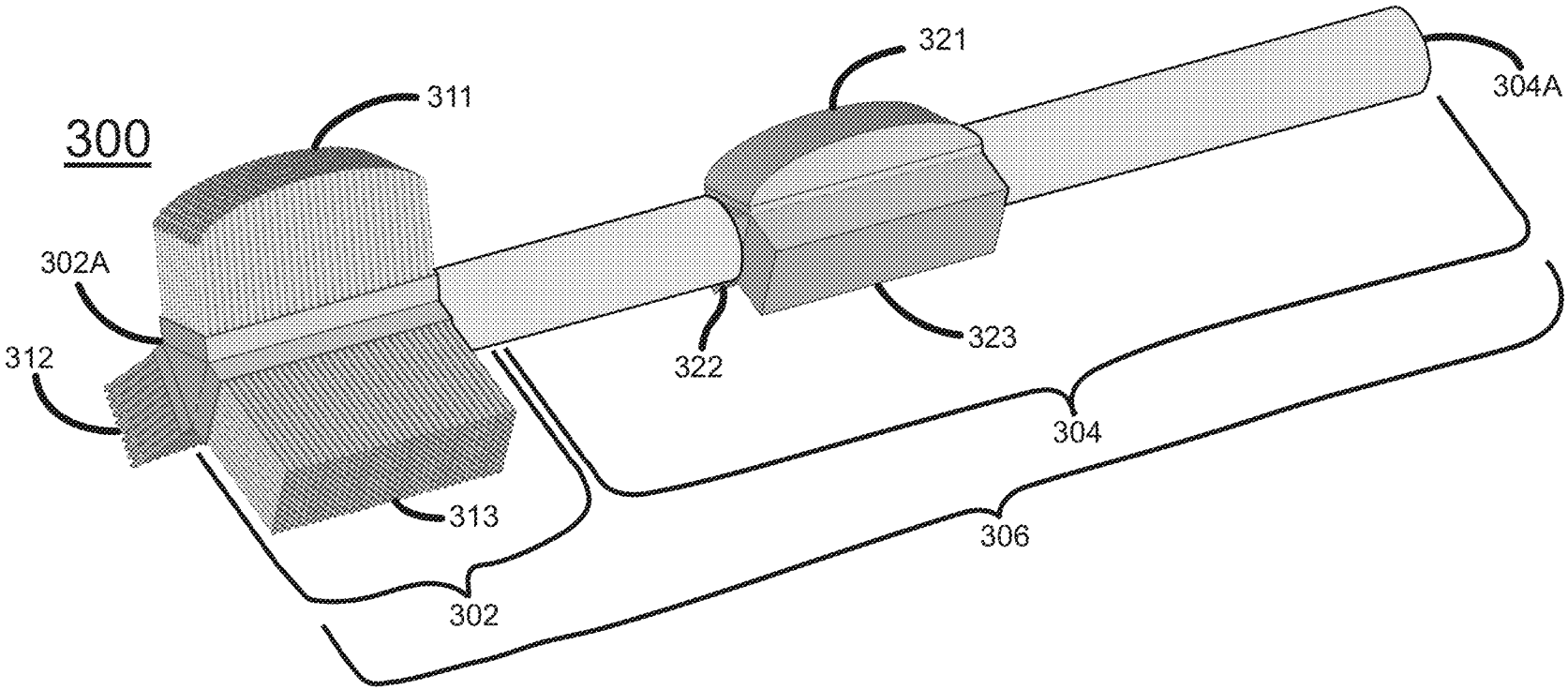
FIG. 3 is a left-end perspective view of one embodiment of the disclosed dental cleaning apparatus wherein the apparatus employs a handle portion exhibiting a circular cross-section, and wherein the apparatus is shown oriented with a convex bristle array and corresponding convex tactile feel region both positioned on top.

While FIGS. 2A-2H show a DCA 200 wherein elongated member 206 exhibits a triangular geometry cross section, other embodiments may employ an elongated member 206 wherein all or a portion of member 206 exhibits other geometries such as circular, elliptical as well as geometries structured to ergonomically fit the human hand. FIG. 3 shows an embodiment of DCA 300 employing such a circular geometry in cross-section. Like numbers indicate like elements when comparing DCA 300 of FIG. 3 with DCA 200 of FIG. 2A. For example, brush portion 302 of DCA 300 corresponds to brush portion 202 of DCA 200. Handle portion 304 of DCA 300 corresponds to handle portion 204 of DCA 200, and so forth.

Figure 2I:
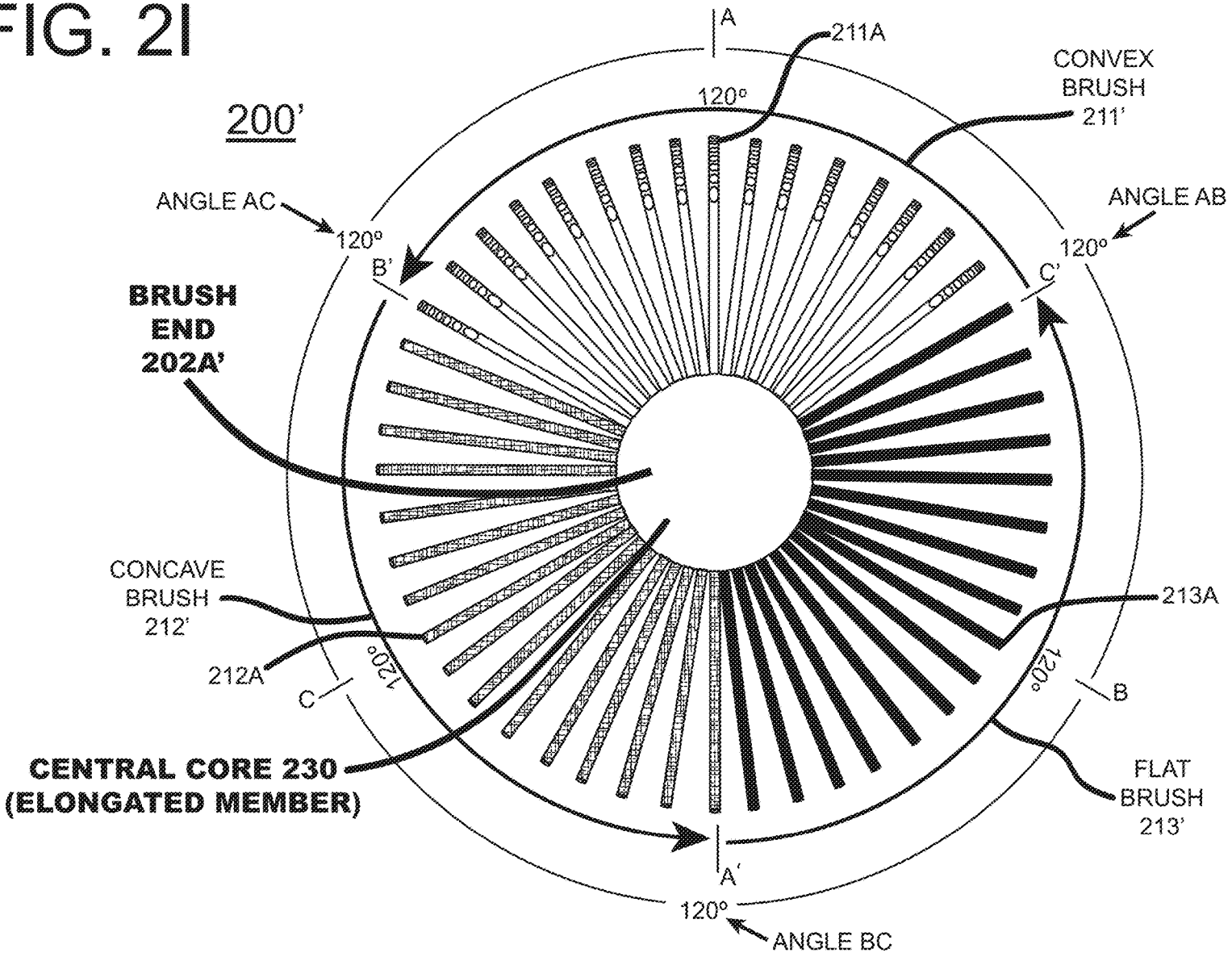
FIG. 2I is a left-end plan view of an embodiment of the disclosed dental cleaning apparatus wherein the three bristle arrays are together circumferentially continuous about the brush portion of the dental cleaning apparatus, each bristle array spanning approximately 120 degrees of the brush portion.

FIG. 2I is a left-end plan view of an embodiment of the disclosed dental cleaning apparatus (DCA) 200'. DCA 200' is similar to DCA 200 of FIG. 2A, but unlike DCA 200 which includes open regions between the three bristle arrays of convex brush 211', concave brush 212', and flat brush 213', the three bristle arrays of DCA 200' are continuous about the circumference of DCA 200' as seen in FIG. 2I. In other words, convex brush 211' is adjacent both concave brush 212' and flat brush 213'. Concave brush 212' is adjacent both convex brush 211' and flat brush 213'. And flat brush 213' is adjacent both convex brush 211' and concave brush 212', as illustrated. In this particular embodiment, convex brush 211', concave brush 212', and flat brush 213' are attached to a central core 230 that forms part of the elongated member 206.

FIG. 2I also shows that convex brush 211', concave brush 212', and flat brush 213' each span approximately 120° in this embodiment. Thus, convex brush 211', concave brush 212', and flat brush 213' cumulatively span 360°. In this manner, DCA 200' provides a circumferentially continuous brush, as opposed to DCA 200 of FIG. 2A which includes open regions 241, 242 and 243 between the three bristle arrays (i.e. brushes) 211, 212 and 213. In DCA 200', the center peripheral region 211A of convex brush 211' is centered about plane A-A'. The center peripheral region 212A of concave brush 212' is centered about plane C-C'. The center peripheral region 213A flat brush 213' is centered about plane B-B'. In this example, the angle between plane A-A' and plane B-B' (designated angle AB) is approximately 120°. The angle between plane B-B' and plane C-C' (designated angle BC) is approximately 120°. And the angle between plane A-A' and plane C-C' (designated angle AC) is approximately 120°. In this manner, the center peripheral regions 211A, 212A and 213A are substantially equiangularly oriented about central core 230. Thus, convex brush 211', concave brush 212', and flat brush 213' are equiangularly oriented about the brush portion of DCA 200', as shown in FIG. 2I.

As noted, FIG. 2I is an end view of DCA 200'. From a perspective viewpoint, convex brush 211' of DCA 200' is similar in appearance to convex brush 211 of DCA 200 of FIG. 2A, except that convex brush 211' of DCA 200' spans approximately 120° about central core 230 as shown. The periphery of convex brush 211' is convex along the elongated member 206 when viewed perpendicular to elongated member 206. From a perspective viewpoint, concave brush 212' of DCA 200' is similar in appearance to concave brush 212 of DCA 200 of FIG. 2A, except that concave brush 212' of DCA 200' spans approximately 120° about central core 230 as shown. The periphery of concave brush 212' is concave along the elongated member 206 when viewed perpendicular to elongated member 206. From a perspective viewpoint, flat brush 213' of DCA 200' is similar in appearance to flat brush 213 of DCA 200 of FIG. 2A, except that flat brush 213' of DCA 200' spans approximately 120° about central core 230 as shown. The periphery of flat brush 213' is flat along the elongated member 206 when viewed perpendicular to elongated member 206.

While DCA 200 is shown in FIG. 2A as including a triangle-shaped elongated member extending from brush end 202A to handle end 204A atop of which tactile feel regions 221, 222 and 223 are situated, it is noted that tactile feel regions 221, 222 and 223 may alternatively be recessed into the elongated member 206. More particularly, tactile feel regions 221, 222 and 223 may be recessed into the handle portion 204 of the elongated member 206. Likewise, tactile feel regions 321, 322 and 323 of DCA 300 of FIG. 3 may be recessed into the circularly shaped handle portion 304 of DCA 300.

In another embodiment, convex brush 211, concave brush 212 and flat brush 213 exhibit different respective colors. In this particular embodiment, convex tactile feel region 221 exhibits the same color as convex brush 211 to which it corresponds. Likewise, concave tactile feel region 222 exhibits the same color as concave brush 212 to which it corresponds. Further, flat tactile feel region 223 exhibits the same color as flat brush 213 to which it corresponds. This color arrangement may assist the user in the orientation and operation of DCA 200.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Process steps may be performed in an order different than those presented for purposes of example Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A dental cleaning apparatus, comprising:

an elongated member including a brush portion and a handle portion respectively situated at opposed ends of the elongated member; and first, second and third bristle arrays situated approximately equiangularly spaced about the brush portion of the elongated member, each of the first, second and third bristle arrays exhibiting a different bristle array geometry, each bristle array geometry being shaped to brush a different type of tooth surface; and;

first, second and third tactile feel regions situated approximately equiangularly about the handle portion and respectively aligned with the first, second and third bristle arrays in respective first, second and third planes, wherein the first bristle array and the first tactile feel region aligned therewith each exhibit a convex geometry, wherein the second bristle array and the second tactile feel region aligned therewith each exhibit a concave geometry, and wherein the third bristle array and the third tactile feel region aligned therewith each exhibit a flat geometry.

2. The dental cleaning apparatus of claim 1, wherein the first, second and third plurality of tactile feel regions are situated atop the elongated member.

3. The dental cleaning apparatus of claim 1, wherein the first, second and third tactile feel regions are recessed into the elongated member.

4. The dental cleaning apparatus of claim 1, wherein the first, second and third bristle arrays each exhibit a different color.

5. The dental cleaning apparatus of claim 1, wherein the handle portion exhibits a geometry that is substantially triangular in cross section.

6. The dental cleaning apparatus of claim 1, wherein the handle portion exhibits a geometry that is substantially round in cross section.

7. The dental cleaning apparatus of claim 1, wherein the handle portion exhibits a geometry that is substantially elliptical in cross section.

8. The dental cleaning apparatus of claim 1, wherein the first, second and third bristle arrays are situated at approximately 0°, approximately 120° and approximately 240° about the brush portion.

9. The dental cleaning apparatus of claim 1, wherein the brush portion and handle portion of the elongated member are integrally formed.

10. The dental cleaning apparatus of claim 1, wherein the brush portion and handle portion are separable.

11. The dental cleaning apparatus of claim 1, further comprising open regions between adjacent bristle arrays of the plurality of bristle arrays.

12. The dental cleaning apparatus of claim 1, wherein the first, second and third bristle arrays together exhibit a circumferentially continuous geometry.

13. A dental cleaning apparatus, comprising:

an elongated member including a brush portion and a handle portion respectively situated at opposed ends of the elongated member;

first, second and third bristle arrays situated at approximately 0°, approximately 120° and approximately 240° about the brush portion; and first, second and third tactile feel regions situated at approximately 0°, approximately 120° and approximately 240° about the handle portion, the first tactile feel region being aligned with the first bristle array in a first plane, the second tactile feel region being aligned with the second bristle array in a second plane, the third tactile feel region being aligned with the third bristle array in a third plane;

wherein the first bristle array and the corresponding first tactile feel region exhibit a convex geometry;

wherein the second bristle array and the corresponding second tactile feel region exhibit a concave geometry; and wherein the third bristle array and the corresponding third tactile feel region exhibit a flat geometry.

14. The dental cleaning apparatus of claim 13, wherein the first, second and third bristle arrays exhibit a first color, a second color and a third color, respectively, wherein the first, second and third tactile feel regions exhibit the same color as the corresponding first, second and third bristle arrays, respectively.

15. The dental cleaning apparatus of claim 13, wherein the first, second and third tactile feel regions are situated atop the elongated member.

16. The dental cleaning apparatus of claim 13, wherein the first, second and third tactile feel regions are recessed into the elongated member.

* * * * *